United States Patent [19]

Wield

[11] Patent Number: 4,778,428

[45] Date of Patent: Oct. 18, 1988

[54] ILLUMINATED FLYING SAUCER

[76] Inventor: Paul J. Wield, 10796 Brookview La., San Diego, Calif. 92131

[21] Appl. No.: 30,675

[22] Filed: Mar. 26, 1987

[51] Int. Cl.[4] ..... A63H 27/00

[52] U.S. Cl. ..... 446/47; 446/485

[58] Field of Search ..... 446/47, 484, 485; 273/424, 425

[56] References Cited

U.S. PATENT DOCUMENTS 3,786,246 1/1974 Johnson et al. ..... 446/47

4,307,538 12/1981 Moffitt ..... 446/47

*Primary Examiner*—Mickey Yu

*Attorney, Agent, or Firm*—Charles C. Logan, II

[57] ABSTRACT

A flying saucer toy having a pair of LED's mounted diametrically opposed to each other on the rim of its disc-shaped body. The LED's are electrically connected to a printed circuit board and batteries which allow the LED's to strobe imperceptably fast at approximately 100 Hz. A touch-sensitive switch has three terminal posts that extend through the top surface of the disc-shaped body and the bottom ends of the terminal posts are soldered to the circuit board to form a mounting structure for the circuit board. When the flying saucer toy is thrown at night the strobing effect will produce the effect of more than twenty lighted points around the disc perimeter depending upon the rotational speed of the disc.

1 Claim, 2 Drawing Sheets

ILLUMINATED FLYING SAUCER

BACKGROUND OF THE INVENTION

The invention relates to a toy and more specifically to a flying saucer toy that has lights on it so that it may be used when it is dark outside.

In use, the thrower holds the flying saucer with its continuous surface upwards, and uses a thumb-uppermost grip on the saucer rim. The thrower's arm is first stretched across his chest, so that the saucer points away from the receiver. The thrower's arm is then swung in a vigorous arc, so that the flying saucer now points toward the receiver, and as the thrower's grip is released, his wrist imparts a pivoting gyroscopic-type motion to the flying saucer.

The flying saucer is quite cleverly aerodynamically designed, having a substantially flat but arched continuous surface, and having a sturdy peripheral rim that permits the operator to acquire a firm handgrip. The projected, pivoting flying saucer acts in the manner of an airplane wing, thus providing aerodynamic lift so that the saucer is capable of sailing a long distance, as much as several hundred feet at times.

Apparently, the instantaneous angle of the flying saucer at the time of its release is very important to its resultant trajectory, certain angles producing straight flight, whereas other angles produce trajectories that curve to the right or to the left. Thus, a skilled thrower can cause the flying saucer to go directly to a receiver, can cause the flying saucer to overshoot the receiver, or can cause the flying saucer to veer just enough to extend the receiver into a hard run to catch the flying saucer.

It is an object of the invention to provide a novel illuminated flying saucer toy that has a unique touch-sensitive electrical switch whose terminal posts are located on the top surface of its disc-shaped body.

It is also an object of the invention to provide a novel illuminated flying saucer toy that has LEDs mounted on the opposite diametrically opposed sides of its downwardly extending rim and having these LEDs connected to a circuit for allowing the lights to stroke imperceptively fast at approximately 100 Hz.

It is another object of the invention to provide a novel illuminated flying saucer toy which provides a unique touch-sensitive electrical switch structure that supports the printed circuit board within the combination battery and printed circuit board housing.

It is an additional object of the invention to provide a novel illuminated flying saucer toy that is economical to manufacture and market.

It is a further object of the invention to provide a novel illuminated flying saucer toy that is lightweight.

SUMMARY OF THE INVENTION

Applicant's novel illuminated flying saucer toy is an injection molded substantially disc-shaped body having two LEDs mounted at the opposite ends of its perimeter. A combination battery and printed circuit board housing is mounted at the disc's center on its underside and it houses a pair of button-type batteries, a printed circuit board, and a unique touch-sensitive switch. The touch-sensitive electrical switch has three terminal posts extending through the top surface of the disc-shaped body and the bottom ends of the terminal posts are soldered to the circuit board to form a mounting structure for the printed circuit board.

The electronic circuit of the device allows the LEDs to strobe imperceptively fast while stationary(approximately 100 Hz). While soaring at night the strobing will cause the effect of more than twenty lighted points around the disc's perimeter depending upon the rotational speed of the disc. The extended battery life of about fifty hours of user on time (actual time that the switch is on) is achieved by duty cycle operation of about 15 percent.

The strobing of the lights is a great improvement over the pre-existing design of constantly on lights because: (1) it appears to be many lights on the perimeter bursting out of a seemingly nowhere instead of just a predictable streak, (2) the strobing of the lights require less energy and hence smaller and lighter batteries which have much less of a detrimental effect on the flight characteristics of the disc, (3) the electronics already in the unique oscillator circuit permit the incorporation of a touch-sensitive switch, and (4) the switch, oscillator and driver electronics require only 3 volts to operate thus eliminating the need for a heavy 9 volt battery whose weight would substantially have a detrimental effect on flight.

The disc is injection molded with low density polyethylene. The LEDs are wire-wrapped with the wires going through a hole to a groove on the top surface of the disc-shaped body. A label strip covers the wires providing graphic display as well as functionality. Three decorative brass nails inserted from the top go through the label, through the disc-shaped body and its downwardly extending bosses, and through the printed circuit board where they are soldered into place providing an electrical connection in addition to the final board restraint. The inside diameter of the bore holes of the bosses is slightly smaller than the outer diameter of the shank portion of the decorative brass nails to provide a watertight fit. Batteries are mounted at the center of the printed circuit board to maintain balance. The combination battery and printed circuit board housing is covered by a removable cap which snaps into place providing a water-tight seal and user access for battery replacement.

DESCRIPTION OF THE PREFERRED EMBODIMENT

Figure 1:
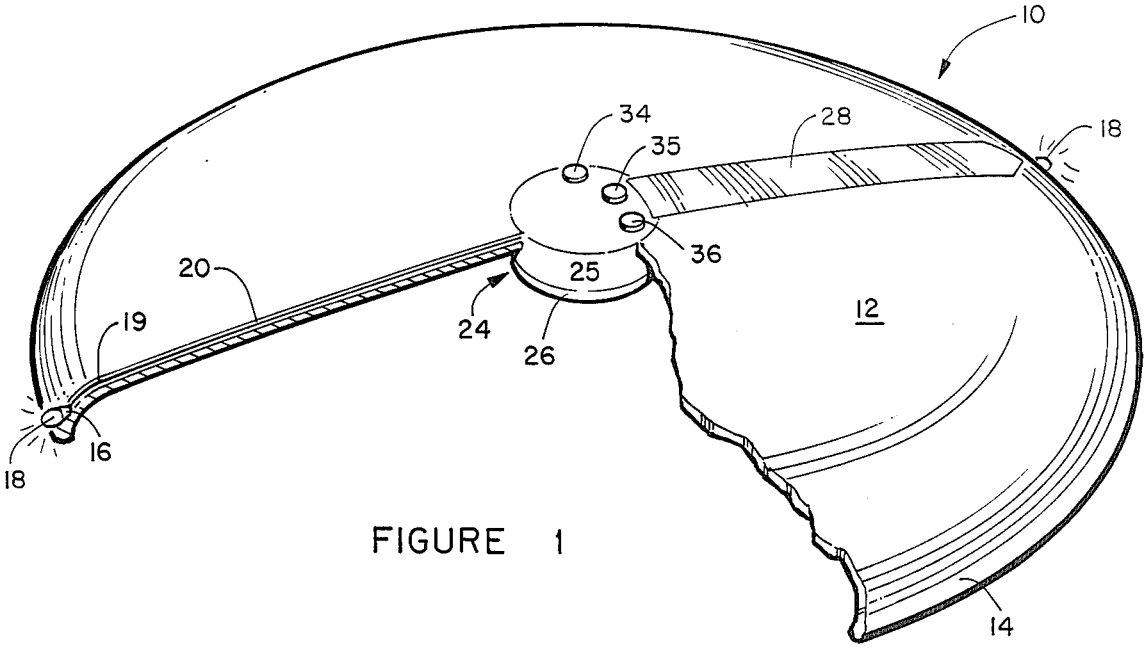
FIG. 1 is a perspective view of applicant's novel illuminated flying saucer toy with portions broken away for clarity.

Applicant's novel illuminated flying saucer toy is generally designated numeral 10. It has a substantially disc-shaped body 12 terminating at its perphery in a downwardly extending rim 14. The top surface of the body 12 is substantially convex and the bottom surface is substantially concave. A pair of apertures 16 are formed in diametrically opposed locations in rim 14. A LED 18 is mounted in each of these apertures 16 and electrical conductor wires 19 travel along grooves 20 in the top surface of body 12. These wires pass through apertures in the top surface of combination battery and printed circuit board housing 24 that is centrally located and which extends downwardly from the bottom surface of disc-shaped body 12. Housing 24 is tubular in shape and the upper edge of its walls are integrally formed with disc-shaped body 12. A cap 26 is removably attached to the bottom of housing 24. A label cover strip 28 covers the electrical wires 19 and grooves 20.

Figure 2:
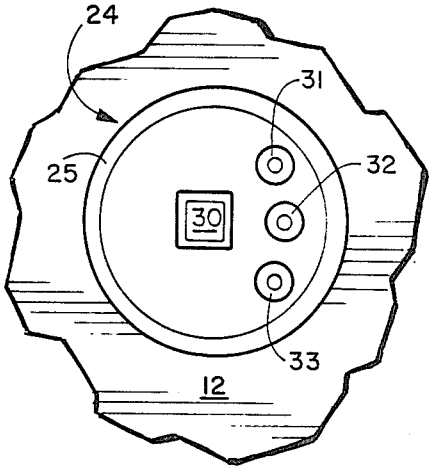
FIG. 2 is a bottom plan view of the combination battery and circuit board housing with its cover and printed circuit board removed.
Figure 5:
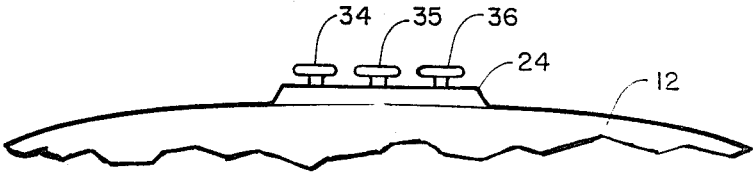
FIG. 5 is a schematic illustration of an alternative version of applicant's novel illuminated flying saucer toy showing the combination battery and printed circuit board housing mounted on the top surface of the flying saucer.
Figure 4:
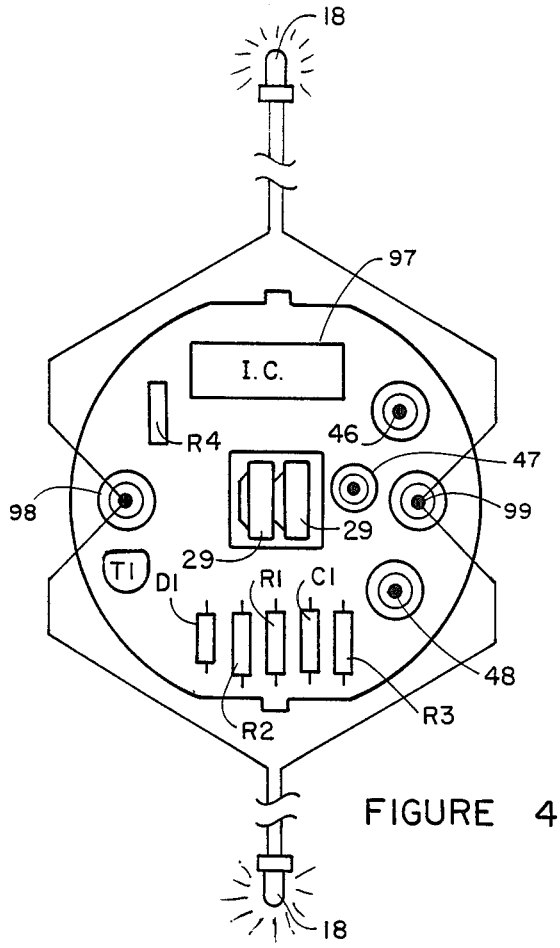
FIG. 4 is schematic illustration of the printed circuit board.

FIG. 2 shows a bottom plan view of the housing 24 with its tubular wall 25. A battery receptacle 30 for batteries 29 is formed therein along with a plurality of downwardly extending bosses 31,32, and 33. Each of these bosses has an aperture in them through which decorative nails 34,35, and 36 are inserted.

Figure 3A:
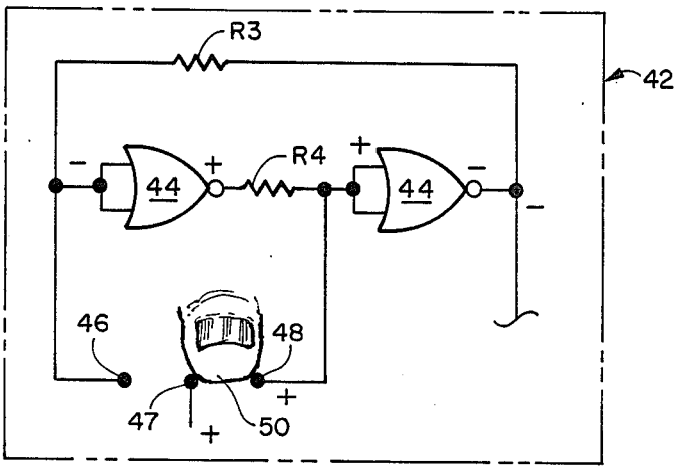
FIG. 3*a* illustrates the switch circuit in a different mode.
Figure 3:
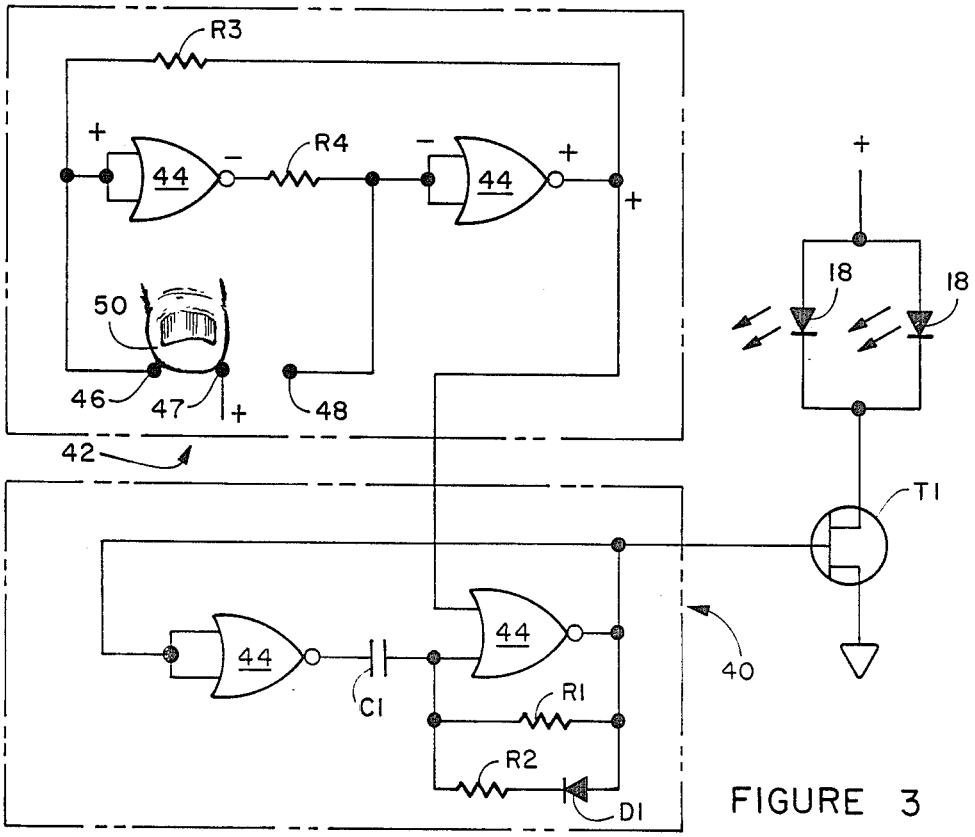
FIG. 3 is a circuit diagram for the illumination system for the flying saucer toy.

A general schematic illustration of the electrical circuit for the illuminated flying saucer 10 is illustrated in FIG. 3. The circuit consists of an oscillator 40 formed from two Quad NOR gate IC's and a finger conductivity sensitive switch 42. A Quad AND gate IC would be interchangable with the Quad NOR gate IC. These units are identified by numeral 44. Finger conductivity sensitive switch 42 has three terminal posts, 46,47, and 48. The center terminal 47 is positive(+). By touching the center terminal and the left terminal simultaneously, the states of the logic gates are forced as shown in FIG. 3. When the finger 50 is released, the states of the logic gates remain as they were(see FIG. 3). Touching the center terminal and the right terminal forces the logic gates to reverse states(see FIG. 3*a*). R1,R2, and C1 of the oscillator determine the frequency and duty cycle output from the logic gates. D1 is a diode. A square wave output then triggers the driver T1 to control the LED's.

What is claimed is:

1. A flying saucer toy comprising:

a substantially disc-shaped body terminating at its periphery in a downwardly extending rim, said body and rim defining a substantially convex upper surface and a substantially concave bottom surface;

a combination battery and circuit board housing centrally located and extending downwardly a predetermined distance from the bottom surface of said disc-shaped body, said housing having a tubular wall whose top end is integrally formed with the bottom surface of said disc-shaped body, said housing also having a removable cap, battery power means mounted in said housing;

two apertures located in said rim, a LED mounted in each of said apertures, said two apertures are positioned diametrically opposed to each other on said rim;

a printed circuit board;

electrical conductor means connecting said LED'S, said battery power means and said printed circuit board;

touch-sensitive electrical switch means for activating said electrical circuit on and off, said switch means having a first electrical circuit having a first inverter in series with a resistor and a second invertor, a resistor in parallel with said first electrical circuit;

said printed circuit board having an oscillator having a logic gate, the output of the second invertor of said switch means being connected to the first input of said logic gate, the output of said logic gate being connected to the input of an invertor in said oscillator, the output of said invertor being connected in series through a capacitor to the second input of said logic gate, a first resistor in parallel with said logic gate, a second resistor in series with a diode also in parallel with said logic gate, a driver, the output of said oscillator coming from the output of the logic gate being connected to the input of said driver; and grooves in the top surface of said disc-shaped body that extend from said respective apertures inwardly to said combination battery and printed circuit board housing and a label cover strip for covering the electrical conductor wires positioned in said grooves.

* * * * *